United States Patent [19]

Kwasnik et al.

[11] 4,412,776

[45] Nov. 1, 1983

[54] APPARATUS FOR OVERHAULING AND REPAIRING DOORS OF HORIZONTAL COKE-OVEN BATTERIES

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 323,975

[22] Filed: Nov. 23, 1981

[30] Foreign Application Priority Data

Nov. 28, 1980 [DE] Fed. Rep. of Germany ..... 3044848

[51] Int. Cl.[3] ..... C10B 25/14

[52] U.S. Cl. ..... 414/684.3; 202/248; 212/166

[58] Field of Search ..... 414/684.3, 754, 763, 414/764, 766, 767, 776, 778, 783; 212/166; 202/248; 269/71, 127, 296

[56] References Cited

U.S. PATENT DOCUMENTS

| | | | |
|---|---|---|---|
| 2,232,150 | 2/1941 | Timmerman | 212/166 |
| 3,191,778 | 6/1965 | Nestler | 212/166 |
| 4,306,831 | 12/1981 | Matsuno et al. | 414/684.3 |

FOREIGN PATENT DOCUMENTS

| | | | |
|---|---|---|---|
| 710747 | 6/1954 | United Kingdom | 202/248 |

*Primary Examiner*—Leslie J. Paperner
*Attorney, Agent, or Firm*—Thomas H. Murray

[57] ABSTRACT

To hold coke-oven doors so that they may be worked upon, apparatus is provided comprising a frame tiltable from an erect to a horizontal position, that frame having mounted within it a second frame which has two pairs of pockets which receive the ends of the door-lifting beams of the door to be worked upon; means are provided to hold at least one pair of ends of door-lifting beams of the door within pockets, and means are provided for pivoting the pocket-containing frame about its central longitudinal axis. Preferably, guide plates are associated with the above-mentioned pockets.

4 Claims, 5 Drawing Figures

APPARATUS FOR OVERHAULING AND REPAIRING DOORS OF HORIZONTAL COKE-OVEN BATTERIES

BACKGROUND OF THE INVENTION

1. Field of the Invention

This invention relates to apparatus for overhauling and repairing the doors of horizontal coke-over batteries.

2. Description of the Prior Art

In known facilities of this kind, which are usually erected at a place at the end of a coke-oven battery, the coke-oven door which is moved by means of the door-handling mechanism is clamped into a pivoted frame by means of the door bolt. The disadvantage of this system is that in the case of handling of coke-oven doors which contain locking systems that use additional clamping elements, such as springs, it is impossible to work on the locking mechanism when the door has been removed from the coke-oven battery with equipment of the kind mentioned above, because the door bolts are being stressed. Moreover, other parts of the door are made inaccessible.

SUMMARY OF THE INVENTION

To hold coke-oven doors so that they may be worked upon, apparatus is provided comprising a frame tiltable from an erect to a horizontal position, that frame having mounted within it a second frame which has two pairs of pockets which receive the ends of the door-lifting beams of the door to be worked upon; means are provided to hold at least one pair of ends of door-lifting beams of the door within pockets, and means are provided for pivoting the pocket-containing frame about its central longitudinal axis. Preferably, guide plates are associated with the above-mentioned pockets.

BRIEF DESCRIPTION OF THE DRAWINGS

A complete understanding of the invention may be obtained from the foregoing and following description thereof, taken in conjunction with the accompanying drawings, in which.

DESCRIPTION OF THE PREFERRED EMBODIMENT

An object of the invention is to avoid the disadvantage mentioned above, namely, that it is impossible to work upon the door bolts and locking mechanism, especially when the door bolts are used to secure the door to the pivoted frame. In accordance with the invention, to engage and clamp the door within the pivoted frame, those ends of the door-lifting beams which extend beyond the side members of the door are used. Disposed in the side walls of the pivoted frames are two pairs of pockets, into which the ends of the door-lifting beams are introduced and lowered. The lower is clamped in the pivoted frame by means of hooks which clamp over the beam ends that have been received in the bottom pockets and which are secured in the clamping position by means of pins and cotters. To facilitate the entry of the beam ends into the pockets, guide plates are disposed on the walls of the pivoted frame above the pockets.

Figure 1:
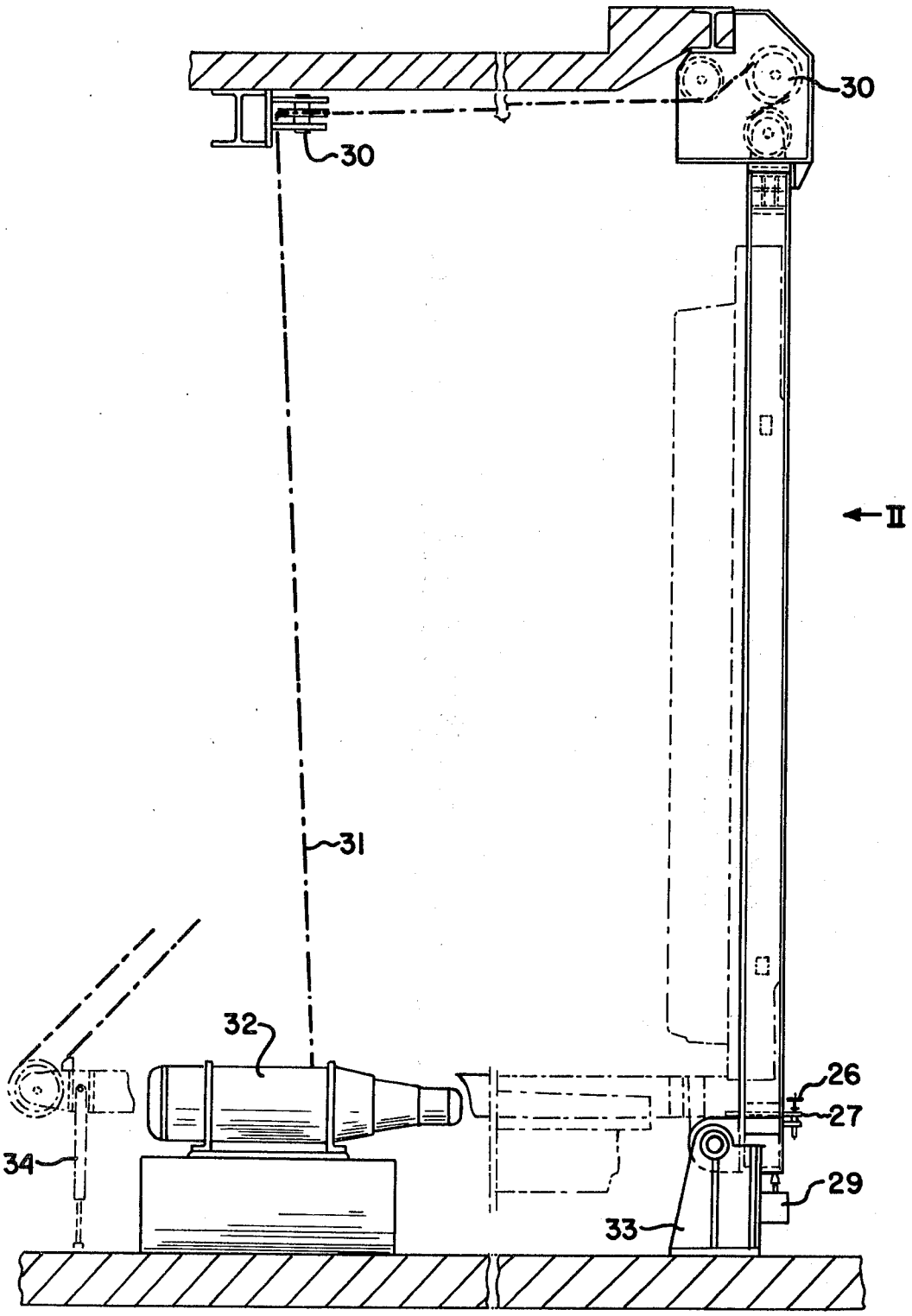
FIG. 1 is an elevational view, looking along the axis of a coke-oven battery towards a door-handling apparatus in accordance with the present invention.
Figure 2:
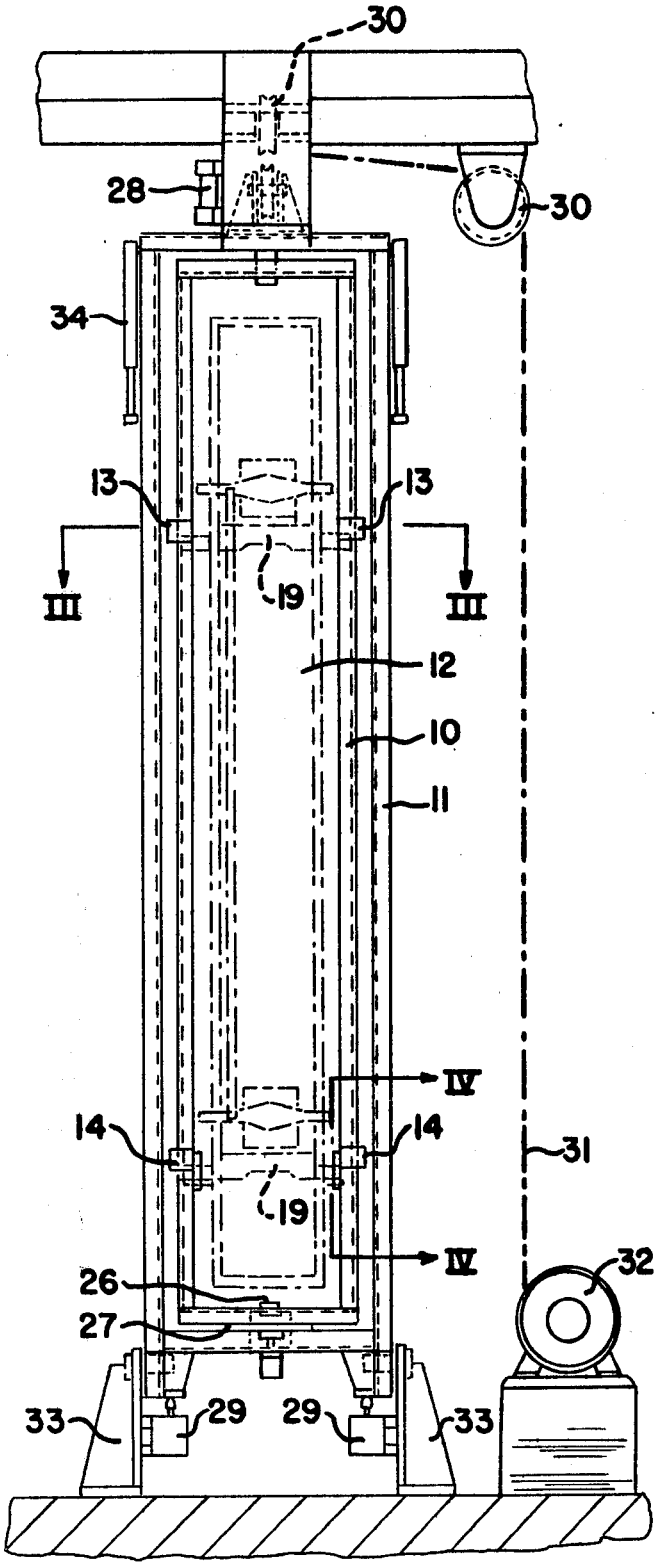
FIG. 2 is an elevational view of apparatus in accordance with the invention, looking in the direction of arrow II—II of FIG. 1.
Figure 3:
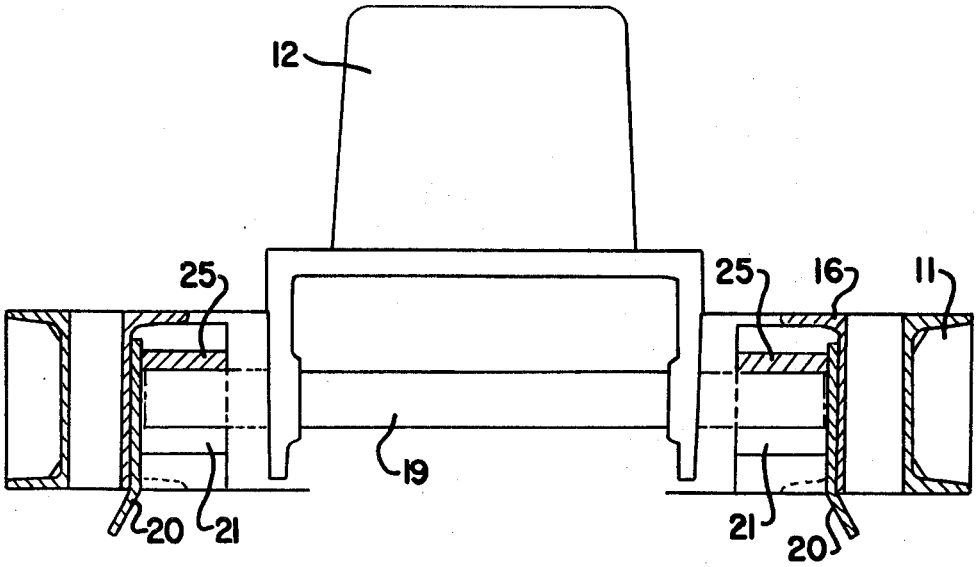
FIG. 3 is a sectional view, to an enlared scale, taken along line III—III of FIG. 2.
Figure 4:
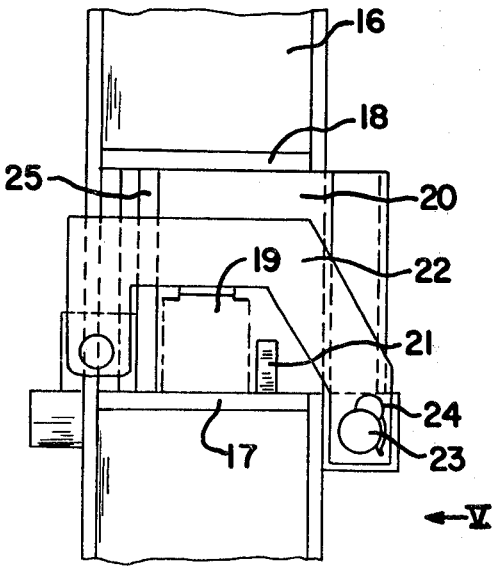
FIG. 4 is another sectional view, also to an enlarged scale, taken along line IV—IV of FIG. 2.
Figure 5:
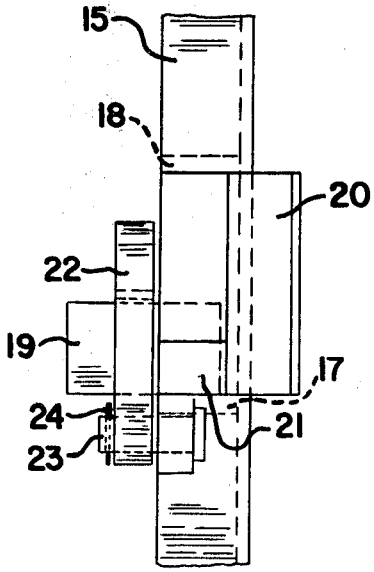
FIG. 5 is an elevational view, to the same scale as FIG. 4, looking in the direction of arrow V of FIG. 4.

The invention explained above is illustrated in the accompanying drawings. As may be seen from FIG. 2, there is a rectangular pivoted frame 10 which is made up of channel section members 16 (see also FIGS. 3 and 4) and is mounted in a tilting frame 11 for rotation about a vertical axis.

The frame 10 is formed with two pairs of pockets 13, 14 into which the ends of door-lifting beams 19 can be introduced, lowered and clamped fast.

Accordingly, a portion of the front flange 15 of the member 16 is removed, and horizontal plates 17, 18 are welded in. A back plate 25, bounding the pocket, and a front plate 21 are placed on the bottom plate 17. To facilitate entry of the ends of beam 19, bent guide members 20 are disposed above the opening of each of the pockets 13, 14.

When the door-handling mechanism moves the door 12 toward the pivoted frame 10, the ends of the beam 19 slide into the pockets 13, 14 and are lowered therein. With the bottom pockets in the position shown in FIG. 4, hooks 22 are placed over the beams 19 and secured by means of a pin 23 and cotter 24. The door is thus clamped in the pivoted frame 10.

The door-removing mechanism operates as follows:

After the door 12 has been engaged in the apparatus by means of the door-handling mechanism of the particular machine concerned—a coke pusher or a coke guide machine—and has been locked by the hooks 22, the pivoted frame 10 is moved into the required position according to the side of the door which it is necessary to work on. To this end, the pin 26 is released, then locked into the required position after the frame 10 has been moved pivotally with respect to frame 11 as required. Since the pin 26 engages in a perforated disc 27 which is formed with an appropriate spacing of perforations, the door can be adjusted to any required position.

The latch of the tilting frame 11 must then be released. The latch comprises a pressure-medium-operated cylinder 28, whose piston rod engages in a recess in the tilting frame 11.

Final control elements 29 are provided to move the apparatus from its normal position. The apparatus, suspended from a rope 31, can then be lowered through the agency of a system of sheaves 30. The raising and lowering are controllable by a winch 32.

The tilting frame is pivotally connected to brackets 33 and has props 34 at its upper end; the props 34 are provided with springs in order to clamp the movement of the door-removing apparatus as it settles into position.

Although the invention has been shown and described in connection with a certain specific embodiment, it will be readily apparent to those skilled in the art that various changes in form and arrangement of parts may be made to suit requirements without departing from the spirit and scope of the invention.

We claim as our invention:

1. Apparatus for overhauling and repairing doors of a horizontal coke-oven battery, said doors each having first and second door-lifting beams which are separate and apart from the locking mechanisms for said doors and which extend horizontally outward from the sides of each door, said apparatus comprising, in combination:

a first frame having in sides thereof first and second pairs of pocket means for receiving ends of said door-lifting beams, a second frame surrounding said first frame, pivot means connecting said first and second frames to permit said first frame to swivel about its central vertical axis within said second frame, means for swiveling said second frame about a horizontal axis at the vicinity of its bottom, and clamping means associated with at least one of said pairs of pocket means for securing said ends of said door-lifting beams therein.

2. Apparatus as defined in claim 1, said apparatus further comprising lateral guide members associated with each of said pocket means for guiding said ends of said door-lifting beams into said pocket means.

3. Apparatus as defined in claim 1 wherein said clamping means associated with at least one of said pairs of pocket means comprises a pair of hooks, and locking means for securing said hooks in positions where they secure the ends of said door-lifting beams within said pocket means.

4. Apparatus as defined in claim 3 wherein each of said hooks is generally C-shaped and has a first leg pivotally connected to said first frame about an axis extending parallel to said lifting beams whey they are in said pocket means, said hooks being pivotal from positions where they permit insertion and removal of the ends of the door-lifting beams with respect to the pocket means to positions where they overlie said ends within the pocket means, said locking means comprising pins which pass through an opening in a second leg of each hook and into an opening in said first frame, and cotters for preventing removal of said pins from said openings in the frist frame and said second legs.

* * * * *